US008591004B2

(12) United States Patent
Kobayashi et al.

(10) Patent No.: US 8,591,004 B2
(45) Date of Patent: Nov. 26, 2013

(54) HEAD UNIT, LIQUID JET DEVICE, AND METHOD FOR ADJUSTING POSITION OF LIQUID JET HEAD

(75) Inventors: Yoshihiro Kobayashi, Matsumoto (JP); Satoshi Tsukahara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 43 days.

(21) Appl. No.: 13/162,480

(22) Filed: Jun. 16, 2011

(65) Prior Publication Data

US 2011/0239431 A1 Oct. 6, 2011

Related U.S. Application Data

(62) Division of application No. 12/367,342, filed on Feb. 6, 2009, now abandoned.

(30) Foreign Application Priority Data

Feb. 8, 2008 (JP) ..... 2008-028496

(51) Int. Cl.
*B41J 2/165* (2006.01)

(52) U.S. Cl.
USPC ..... 347/40

(58) Field of Classification Search
None
See application file for complete search history.

(56) References Cited

U.S. PATENT DOCUMENTS

| | | | | |
|---|---|---|---|---|
| 4,738,552 | A | 4/1988 | Kikuchi et al. | |
| 6,250,731 | B1 * | 6/2001 | Hashimoto | 347/8 |
| 6,554,398 | B2 * | 4/2003 | Wyngaert et al. | 347/42 |
| 2007/0019214 | A1 * | 1/2007 | Saito | 358/1.1 |
| 2009/0244161 | A1 * | 10/2009 | Yamamoto et al. | 347/17 |

FOREIGN PATENT DOCUMENTS

JP 2006-188013 7/2006

OTHER PUBLICATIONS

Office Action dated Mar. 17, 2011 from U.S. Appl. No. 12/367,342.

* cited by examiner

*Primary Examiner* — Matthew Luu
*Assistant Examiner* — Alejandro Valencia
(74) *Attorney, Agent, or Firm* — Workman Nydegger

(57) ABSTRACT

A head unit for fixing a liquid jet head which ejects liquid includes a base component and movable component that slides on the base component and to which the liquid jet head is fixed. A fixing screw fixes the movable component to the base component. A locating member attached to the base component limits a movement direction in which the movable component moves. The movable component has a contact portion touching the locating member and first and second tapered surfaces formed thereon. A vector normal to the first tapered surface has a first component vector extending in the movement direction. A vector normal to the second tapered surface has a second component vector that is opposite the first component vector and extends in the movement direction. The base component has first and second pins accessible to the first and second tapered surfaces, respectively.

2 Claims, 7 Drawing Sheets

HEAD UNIT, LIQUID JET DEVICE, AND METHOD FOR ADJUSTING POSITION OF LIQUID JET HEAD

BACKGROUND

1. Technical Field

The present invention relates to a head unit having a liquid jet head, a liquid jet device with the head unit, and a method for adjusting a position of the liquid jet head.

2. Related Art

There has been known a head unit with a position adjustable liquid jet head and a liquid jet device with a plurality of the head units, in particular an ink jet device including a recording head having a position adjusting portion and a tabular head fixing portion, both of which are fixed to a thin-plate module base by a fixing member including a screw (see pages 9 to 11 and FIGS. 2 and 3 of JP-A-2006-188013).

However, in such devices, position adjustment is conducted individually for each of a plurality of the liquid jet heads. Therefore, all liquid jet heads require mechanisms to achieve the position adjustment, which leads to a complex structure and a prolonged period of the adjustment, whereby cost reduction is difficult to achieve. Furthermore, it is difficult to fix each of the liquid jet heads at an accurate position, since the position adjustment needs to be conducted at an extremely high precision on the order of micrometers.

SUMMARY

An advantage of some aspects of the invention is that some of the foregoing deficiencies are obviated. The embodiments of the invention are implemented in the following aspects or exemplary applications.

FIRST ASPECT OF THE INVENTION

A first aspect of the invention provides a head unit for fixing a liquid jet head which ejects liquid, including: a base component; a movable component slidable on the base component and fixedly carrying the liquid jet head; a fixing screw fixing the movable component to the base component; and a locating member limiting a movement direction in which the movable component moves, the locating member being provided to the base component, wherein the movable component has a contact portion for contact with the locating member, a first tapered surface and a second tapered surface formed thereon; wherein a vector normal to the first tapered surface has a first component vector extending in the movement direction and a vector normal to the second tapered surface has a second component vector extending in the movement direction, the directions of the first component vector and the second component vector are opposite to each other; and wherein the base component has a first pin accessible to the first tapered surface and a second pin accessible to the second tapered surface.

According to this aspect, a force applied to the first tapered surface when the first pin is touching the first tapered surface and a force applied to the second tapered surface when the second pin is touching the second tapered surface have component vectors counter to each other. The forces counter to each other, each of which is applied to one of the first and second tapered surfaces, stably determine the position in the movement direction of the movable component having the first and second tapered surfaces. Therefore, a degree of misregistration of the movable portion remains low during fixing of the movable component to the base component with the fixing screw, so that it is possible to obtain the head unit in which the liquid jet head is fixed at an exact position.

The foregoing head unit may further include a second movable component which moves in a second movement direction different from the movement direction, the second movable component being provided in a manner in which the movable component functions as the base component, wherein the liquid jet head is fixed to the second movable component. With this configuration, the liquid jet head is position adjusted in a plurality of movement directions, so that the misregistration of the movable component and the second movable component, which is caused by the rotation of the fixing screw, remains small. Therefore, it is possible to obtain the head unit in which the liquid jet head is fixed at the exact position in a plurality of directions.

One of the first pin and the second pin may be capable of being tightened in the foregoing head unit. With this configuration, forces counter to each other are strengthened by screwing one pin, each of the forces being applied to each of the first and second tapered surfaces, so that the position in the movement direction of the movable component relative to the base component is determined more stably.

The foregoing head unit may further include a resilient member which urges the movable component in directions toward the locating member and toward the first or second pin. With this configuration, the movable component is urged to the locating member provided on the base component. Therefore, the movement of the movable component in directions other than the movement direction is prevented. The movable component is pressed by one of the first pin and the second pin. Therefore, one of the first and second pins safely touches the tapered portion formed on the movable component, so that the position in the movement direction of the movable component is more stably determined.

The first or second pin which is capable of being tightened may be tightened by screwing; and a direction of a force applied to the first or second tapered surface at a position where the first or second pin and the first or second tapered surface are in contact includes a direction from the contact portion formed on the movable component to the locating member, in the foregoing head unit.

With this configuration, the pin which is capable of being tightened is safely tightened by screwing, whereby the force is safely applied to the tapered surface with which the pin is in contact. Therefore, the position in the movement direction of the movable component is determined more stably. Also, the force applied to the tapered surface at the position in which the pin touches the surface includes the component vector toward the locating member, therefore the movable component is urged to the locating member more strongly, so that the movement in the directions other than the movement direction of the movable component is more surely prevented. Therefore, the position in the movement direction of the movable component is more stably determined.

At least one of the first pin and the second pin may be detachable in the foregoing head unit. With this configuration, at least one of the first and second pins can be detached from the head unit to which the liquid jet head is fixed at the exact position by the fixing screw, so that the head unit after the detachment can be miniaturized. Furthermore, it is possible to obtain the head unit in which the plurality of liquid jet heads can be position adjusted and fixed without using many pins.

The first pin may have a tapered portion which is contactable with the first tapered surface and the second pin has a tapered portion which is contactable with the second tapered surface in the foregoing head unit. With this configuration, the first and second tapered surfaces are in face contact with the tapered portions of the first and second pins, respectively. Therefore, the forces applied to the contact positions are distributed, thereby decreasing friction between the first pin and the first tapered surface and between the second pin and the second tapered surface. Therefore, it is possible to obtain the head unit with which moving the first and second pins while being in contact with the tapered surfaces is facilitated.

SECOND ASPECT OF THE INVENTION

According to a second aspect of the invention, a liquid jet device includes one or more foregoing head units.

With this configuration, only the head unit having the ink jet head which needs to be position adjusted is selectively position adjusted. Therefore, the liquid jet device which has a simplified structure can be obtained, so that time reduction for an adjustment and cost reduction can be achieved.

THIRD ASPECT OF THE INVENTION

A third aspect of the invention provides a method for adjusting a position of a liquid jet head in a liquid jet device having a plurality of head units each including the liquid jet head, the method including: detaching a head unit which needs to be position adjusted from a liquid jet device; attaching a head unit with a position-adjustable liquid jet head to the liquid jet device; checking a jet pattern; position adjusting the liquid jet head; temporarily fixing the liquid jet head; and fixing the liquid jet head.

With this configuration, only the liquid jet head which needs to be position adjusted is selectively position adjusted. Therefore, the liquid jet device which has a simplified structure can be obtained, and hence the method for adjusting the position of the liquid jet head, which enables time reduction for the adjustment and cost reduction, can be obtained.

The head unit may have a base component, a movable component which slides on the base component, a fixing screw fixing the movable component to the base component, and a locating member limiting a movement direction in which the movable component moves, the locating member being provided to the base component, wherein the movable component has a contact portion touching the locating member, and a first tapered surface and a second tapered surface formed thereon, wherein a vector normal to the first tapered surface has a first component vector extending in the movement direction and a vector normal to the second tapered surface has a second component vector extending in the movement direction, the directions of the first component vector and the second component vector are opposite to each other, and the base component has a first pin accessible to the first tapered surface and a second pin accessible to the second tapered surface in the forgoing method for adjusting the position of the liquid jet head. With this configuration, the head unit has the movable component, the first and second tapered surfaces formed on the movable component, the first pin which can touch the first tapered surface, and the second pin which can touch the second tapered surface. The force applied to the first tapered surface when the first pin is touching the first tapered surface and the force applied to the second surface when the second pin is touching the second tapered surface have component vectors counter to each other in the movement direction. The forces having component vectors counter to each other safely determine the position of the movable component with the first and second tapered surfaces in the movement direction relative to the base component, each of the forces acting on one of the tapered surfaces. Therefore, the method for adjusting the position of the liquid jet head, which exhibits the foregoing advantages, is obtained.

The position adjusting may be effected by one of the first pin and the second pin while the movable component is urged to the locating member, the movable component is temporarily fixed to the base component with the first pin or the second pin which is different from the pin for the position adjusting in the temporary fixing, and the movable component is fixed to the base component with the fixing screw in the fixing, in the forgoing method for adjusting the position of the liquid jet head. With this configuration, the movable component is fixed to the base component by the fixing screw after the movable component is position adjusted and temporarily fixed to the base component by the first and second pins. Therefore, the method for adjusting the liquid jet head can be obtained, the misregistration of the movable component caused by the rotation of the fixing screw being suppressed with the method.

The forgoing method for adjusting the position of the liquid jet head may include detaching at least one of the first pin and the second pin. With this configuration, at least one of the first pin and the second pin is detached, and hence, it is possible to re-conduct position adjusting and fixing by reattaching the detached pin, in the case position adjusting and fixing is required again.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
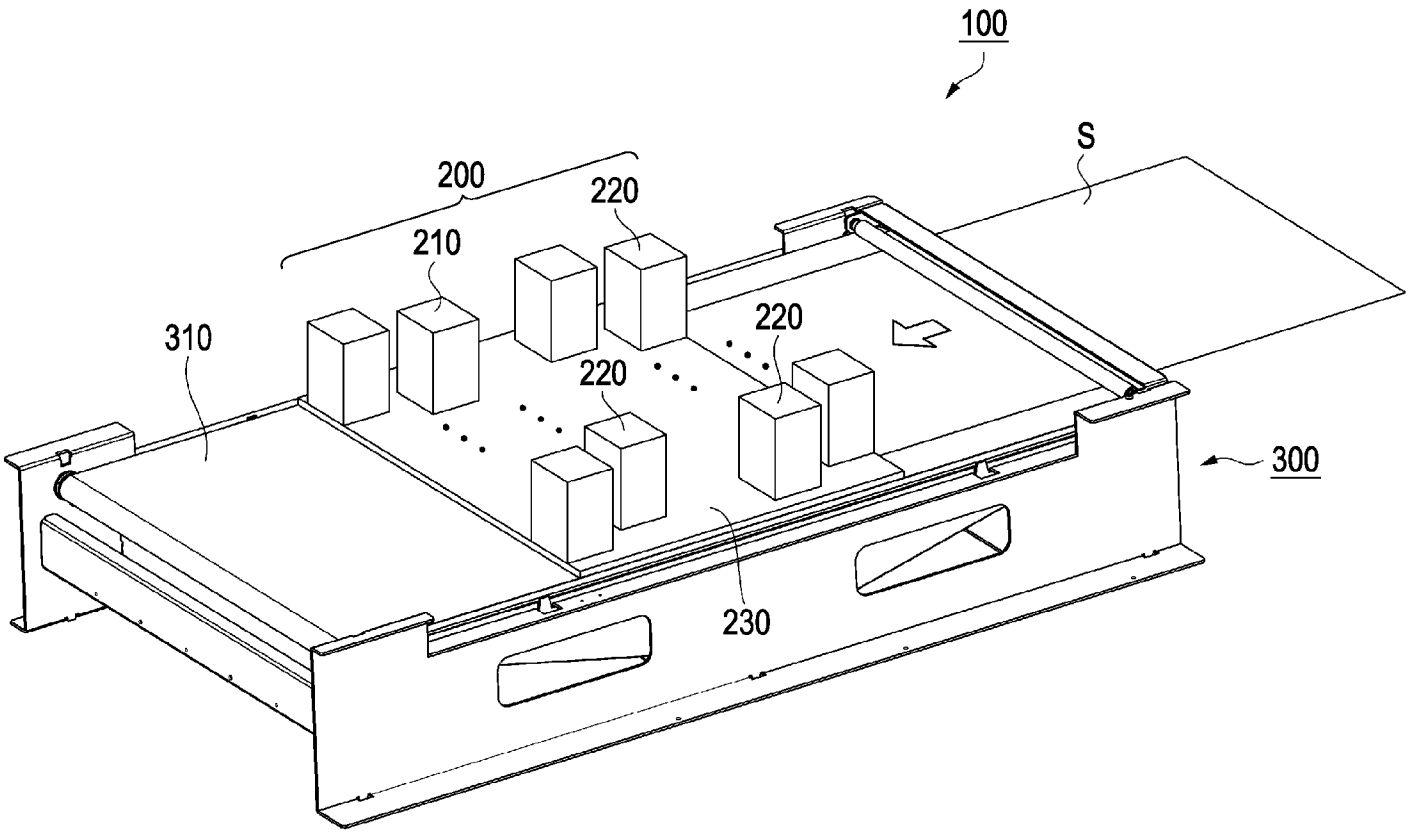
FIG. 1 is a schematic fragmentary perspective view of an image-forming device as a liquid jet device.

FIG. 1 is a schematic fragmentary perspective view of an image-forming device 100 as a liquid jet device of an embodiment. As shown in FIG. 1, the image-forming device 100 has a group of head units 200 and a transporting unit 300. The image-forming device 100 is a color-image forming device forming an image by ejecting liquid ink droplets, typically referred to as a so-called "line printer".

The group of the head units 200 has one or more first head units 210, serving as liquid jet heads, including a position adjustable ink jet head, and second head units 220 each including a fixed ink jet head. Not all of the first and second head units 210 and 220 are shown and some are omitted in FIG. 1. The outline arrow shown in FIG. 1 indicates a transporting direction of a recording medium S. The recording medium S is transported by a belt 310 of the transporting unit 300.

As shown in FIG. 1, the first head units 210 and the second head units 220 are carried by a sub-carriage 230 and positioned to face one side of the recording medium S transported by the transporting unit 300. The sub-carriage 230 is fixed on the transporting unit 300. Also, the first head units 210 and the second head units 220 are arranged into four lines, each line oriented perpendicular to the transporting direction. Each two lines form a pair among these four lines. The arrangement of the pair of lines of the first head units 210 and the second head units 220 is such that the lines are shifted in a direction perpendicular to the transporting direction so as to be positioned in a so-called staggered arrangement.

Figure 2:
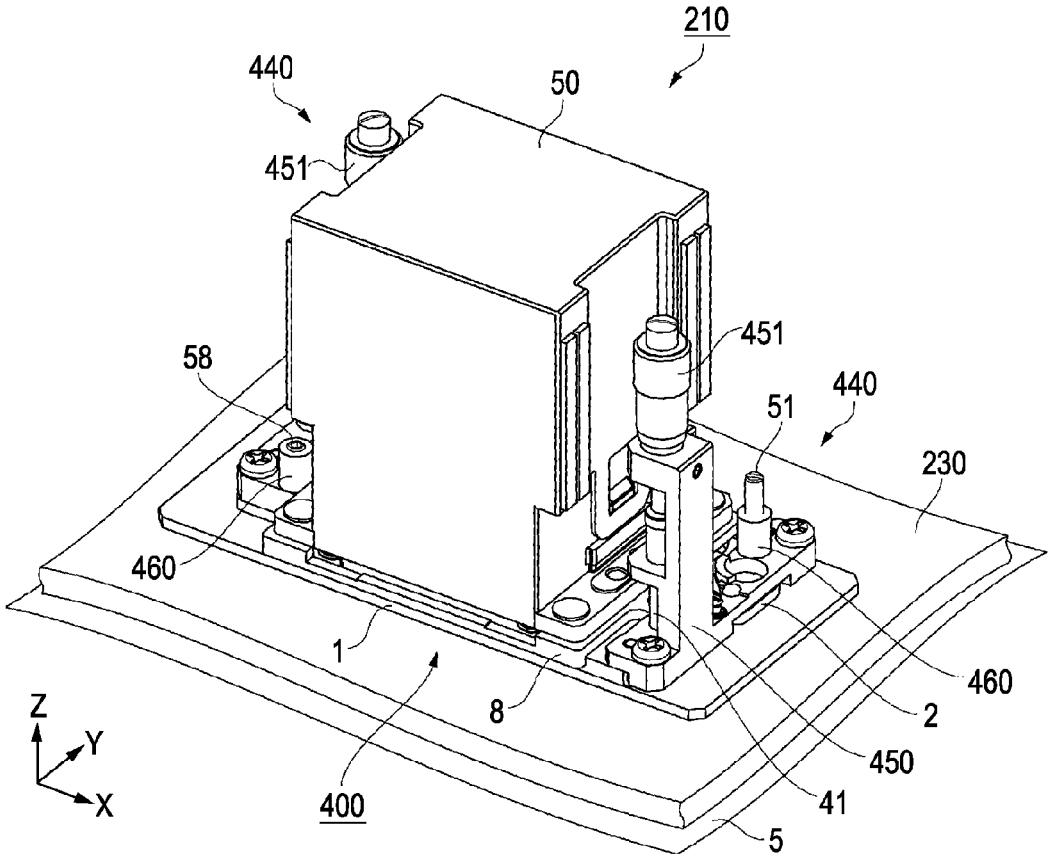
FIG. 2 is a perspective view of a position adjustable first head unit.
Figure 3:
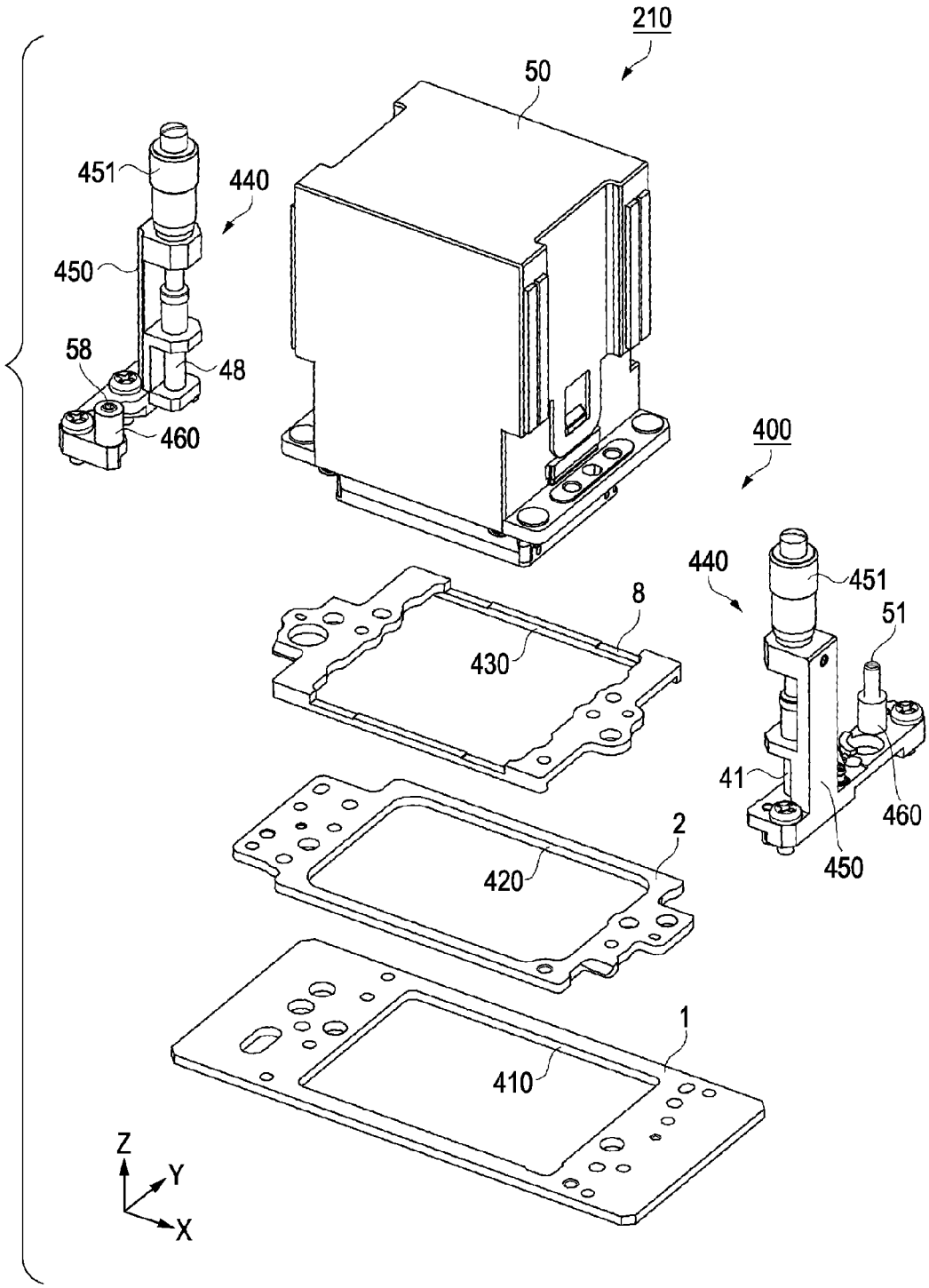
FIG. 3 is an exploded perspective view of the first head unit.

FIG. 2 shows a perspective view of the position adjustable first head unit 210. FIG. 3 shows an exploded perspective view of the first head unit 210. The x-axis, y-axis and z-axis, being mutually perpendicular, are illustrated in FIGS. 2 and 3. As shown in FIGS. 2 and 3, the first head unit 210 has an ink jet head 50 and a fixing unit 400. The ink droplets are ejected from nozzle orifices (not shown) to a side of the recording medium S facing the ink jet head 50, whereby an image is formed on the recording medium S. The fixing unit 400 has a base plate 1 as a base component, a movable plate 2 as a movable component, and a second movable plate 8 as a second movable component. The movable plate 2 is movable relative to the base plate 1, while the second movable plate 8 is movable relative to the movable plate 2. The base plate 1, the movable plate 2 and the second movable plate 8 are substantially tabular rectangular parallelepipeds, and the x-axis, y-axis and z-axis directions in the figures correspond to three edges of the parallelepiped, intersecting at right angles to one another. The base plate 1 is fixed to the sub-carriage 230. Referring to FIG. 3, the ink jet head 50 loosely fits into through holes 410, 420 and 430 which are bored through the base plate 1, the movable plate 2 and the second movable plate 8, respectively. Also, the ink jet head 50 is fixed to the second movable plate 8.

The fixing unit 400 includes two position-adjusting temporary-fixing units 440 arranged in the X-axis direction, with the ink jet head 50 therebetween. Each of the position-adjusting temporary-fixing units 440 has a position-adjusting component 450 and a temporary-fixing component 460. Each of the two position-adjusting temporary-fixing units 440 is detachably fixed to the base plate 1 and the movable plate 2. Additionally, the two position-adjusting temporary-fixing units 440 may be different from each other in terms of structure, for example, in terms of the size of the components forming the units.

Each of the position-adjusting components 450 has a micrometer 451 disposed thereon. Position-adjusting pins 41 and 48, each serving as a first pin, are attached to the micrometers 451, 451, respectively, for cooperation with the associated micrometers 451, 451. Temporary-fixing screws 51 and 58, each serving as a second pin, are provided on the temporary-fixing components 460, 460, respectively. Here, the position-adjusting pins 41 and 48, and the temporary-fixing screws 51 and 58 are movable in the Z-axis direction by operating the micrometer 451 and by rotating the screws, respectively.

Figure 4:
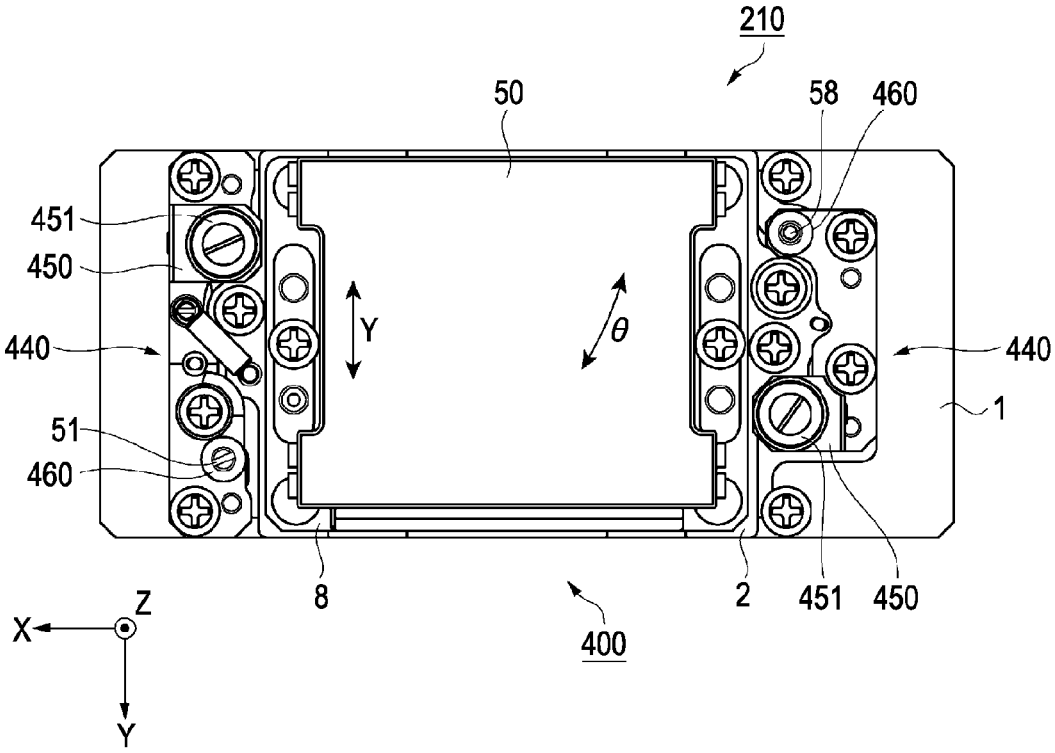
FIG. 4 is a plan view of the first head unit.

FIG. 4 is a plan view of the first head unit 210. In the figure, arrows indicate directions of movement of the movable plate 2 and the second movable plate 8. The movable plate 2 is movable relative to the base plate 1 in the Y-axis direction, while the second movable plate 8 is movable relative to the movable plate 2 in the θ direction. Therefore, the ink jet head 50 fixed to the second movable plate 8 is position adjustable relative to the base plate 1 in two, i.e., Y-axis and θ, directions.

Figure 5A:
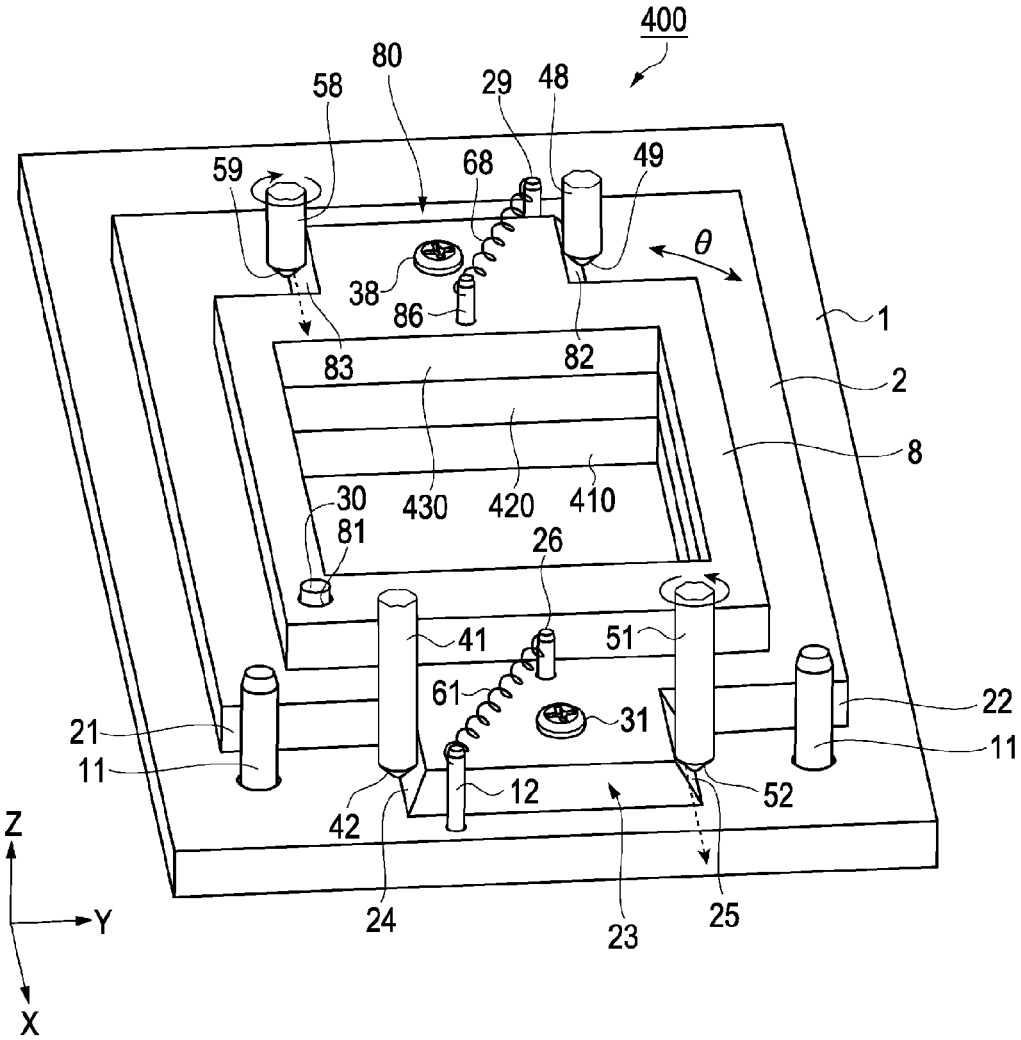
FIG. 5A is a schematic fragmentary perspective view of a fixing unit.
Figure 5B:
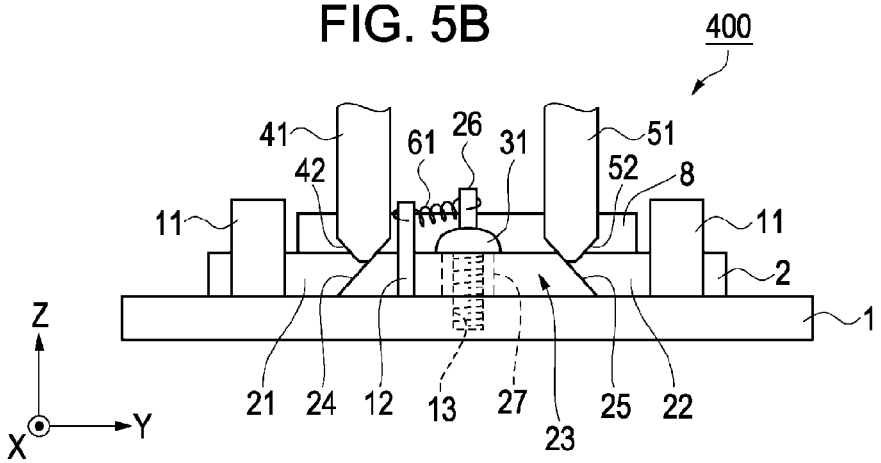
FIG. 5B is a schematic front view of the fixing unit.

The fixing unit 400 will now be described in detail with reference to schematic views for illustration. FIG. 5A is a schematic fragmentary perspective view of the fixing unit 400. FIG. 5B is a schematic front view of the fixing unit 400. The fixing unit 400 has the base plate 1, the movable plate 2, the second movable plate 8, fixing screws 31 and 38, the position-adjusting pins 41 and 48, the temporary-fixing screws 51 and 58, and springs 61 and 68 each serving as a resilient member. As shown in FIGS. 2 and 3, the position-adjusting pins 41 and 48 and the temporary-fixing screws 51 and 58 are provided on the position-adjusting temporary-fixing units 440 and 440, respectively.

The base plate 1 and the movable plate 2 are arranged in a manner such that their major surfaces are in sliding contact with each other. The second movable plate 8 is carried by the movable plate 2 which serves as a base plate therefor. The second movable plate 8 is also a substantially plate-like rectangular parallelepiped. The second movable plate 8 is provided so as to be slidably in contact with the side of the movable plate 2 opposite to the side adjacent to the base plate 1. Also, these sides of the plates are parallel to one another. FIGS. 5A and 5B show the x-axis, y-axis and z-axis directions parallel to three edges of the base plate 1, as is the case with FIGS. 2 and 3.

The movable plate 2 will now be described. Referring to FIGS. 5A and 5B, cylindrical first locating members 11 are individually provided at two positions on the base plate 1. The first locating members 11 are in contact with corresponding sidewalls 21 and 22 each serving as a contact surface of the movable plate 2. The first locating members 11 and the sidewalls 21 and 22 in cooperation prevent movement of the movable plate 2 in the X-axis direction, therefore the movable plate 2 is movable only in the Y-axis direction. Additionally, it suffices only that the sidewalls 21 and 22 are parallel to the Y-axis direction. The sidewalls 21 and 22 may be co-planar with each other, or otherwise the sidewall 21 may be offset from the sidewall 22 in the X-axis direction. In the latter case, it is necessary to correspondingly offset the two first locating members 11 from each other in the X-axis direction.

The base plate 1 and the movable plate 2 have retaining members 12 and 26, respectively, for retaining opposite ends of a spring 61. The retaining member 12 and the retaining member 26 are positioned at opposite sides of a line which interconnects two first locating members 11. Also, the retaining member 12 is positioned closer to the first locating member 11 adjacent to the position-adjusting pin 41 than to the other first locating member 11. With such an arrangement, the sidewalls 21 and 22 of the movable plate 2 are urged to the first locating member 11 by the spring 61, and besides the movable plate 2 is urged to the position-adjusting pin 41.

The movable plate 2 has a protruding portion 23 formed between the sidewalls 21 and 22. The protruding portion 23 has a first tapered surface 24 and a second tapered surface 25 formed thereon. The first tapered surface 24 and the second tapered surface 25 have the following relation.

Figure 6:
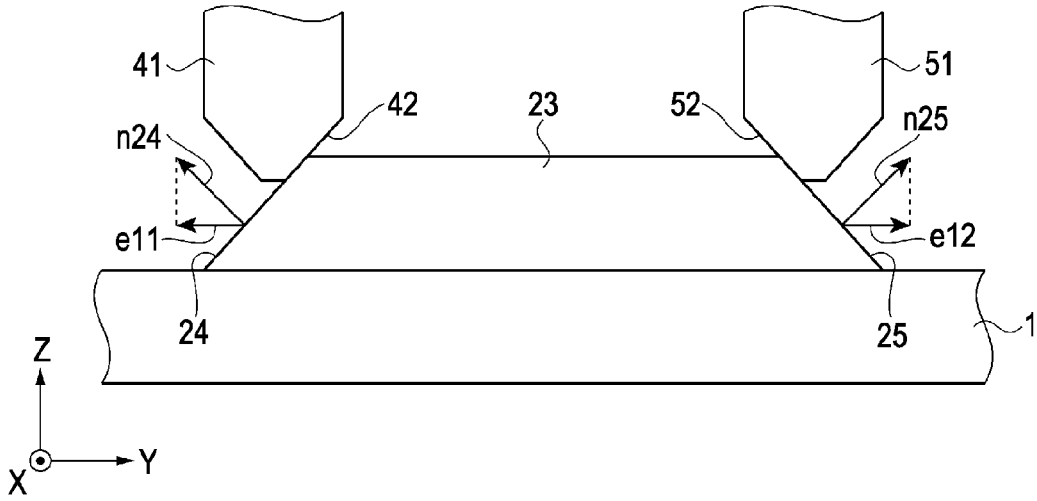
FIG. 6 is a schematic front view in the vicinity of a protruding portion.

FIG. 6 is a schematic front view of the portion including the protruding portion 23 and therearound. Only the first tapered surface 24, the second tapered surface 25, the position-adjusting pin 41 and the temporary-fixing screw 51 are shown in the figure, other components are not shown in the figure. A normal vector n24 to the first tapered surface 24 has a first component vector e11 extending in the Y-axis direction as a movement direction. A normal vector n25 to the second tapered surface 25 has a second component vector e12 extending in the Y-axis direction. Directions of the first and second component vectors e11 and e12 are opposite to each other.

Referring to FIGS. 5A, 5B and 6, the position-adjusting pin 41 has a tapered portion 42 formed at one end thereof, and the temporary-fixing screw 51 has a tapered portion 52 formed at one end thereof. The tapered portion 42 of the position-adjusting pin 41 and the tapered portion 52 of the temporary-fixing screw 51 are arranged to be brought into contact with the first tapered surface 24 and the second tapered surface 25, respectively. The movable plate 2 is position adjusted using contacts occurring at the following three positions: a position at which one first locating member 11 is touched by the sidewall 21; a position at which the other first locating member 11 is touched by the sidewall 22; and a position at which the position-adjusting pin 41 touches the first tapered surface 24.

The temporary-fixing screw 51 is a left-hand screw as shown in FIG. 5A (the rotation direction for tightening the screw is indicated by the arrow in the figure). Referring to FIG. 5B, the base plate 1 has a threaded bore 13 formed therein, and the protruding portion 23 of the movable plate 2 has a bore 27 formed therein, the diameter of the bore 27 being larger than that of the fixing screw 31. Therefore, the movable plate 2 is movable relative to the base plate 1 in the Y-axis direction, with the fixing screw 31 loosened. The fixing screw 31 is screwed through the bore 27 into the threaded bore 13, with the external thread thereof engaging with the thread of the threaded bore 13, so as to fix the movable plate 2 to the base plate 1.

The second movable plate 8 will now be described. Referring now to FIG. 5A, the movable plate 2 has a single cylindrical second locating member 30 provided at one (lower left in the figure) of the four corners thereof. The second movable plate 8 has a bore 81 serving as a contact portion formed therein, while the second locating member 30 pierces through the circular bore 81. Therefore, the second movable plate 8 is rotatable (in the direction indicated by the arrow with a symbol θ in FIGS. 4 and 5) about the second locating member 30 but its movement is limited by the contact of the second locating member 30 and the internal surface of the bore 81. Also the second movable plate 8 has a protruding portion 80 formed at a side parallel to the side at which the protruding portion 23 of the movable plate 2 is formed. The protruding portion 80 has a first tapered surface 82 and a second tapered surface 83 formed thereon. The relation between the first tapered surface 82 and the second tapered surface 83 is the same as that between the first tapered surface 24 and the second tapered surface 25.

A tapered portion 49 of the position-adjusting pin 48 and the tapered portion 59 of the temporary-fixing screw 58 are arranged to be contactable with the first tapered surface 82 and the second tapered surface 83, respectively. The movable plate 2 and the second movable plate 8 have a retaining member 29 and a retaining member 86, respectively, for retaining opposite ends of a spring 68. Also, the retaining member 29 is positioned in the vicinity of the position-adjusting pin 48. With such an arrangement, the second movable plate 8 is urged to the position-adjusting pin 48, while the inner surface of the bore 81 of the second movable plate 8 abuts against the second locating member 30 by the spring 68.

Adjusting and fixing the position in the θ direction is conducted as is the case with adjusting and fixing the position in the Y-axis direction. More specifically, it is conducted on the basis of the contact between the position-adjusting pin 48 and the first tapered surface 82, the contact between the temporary-fixing screw 58 and the second tapered surface 83, and the fixing screw 38. Here, different from the position adjustment in the Y-axis direction is that the position of contact between the position-adjusting pin 48 and the first tapered surface 82 moves not only in the Y-axis direction but also in the X-axis direction due to the rotation of the second movable plate 8.

Figure 7:
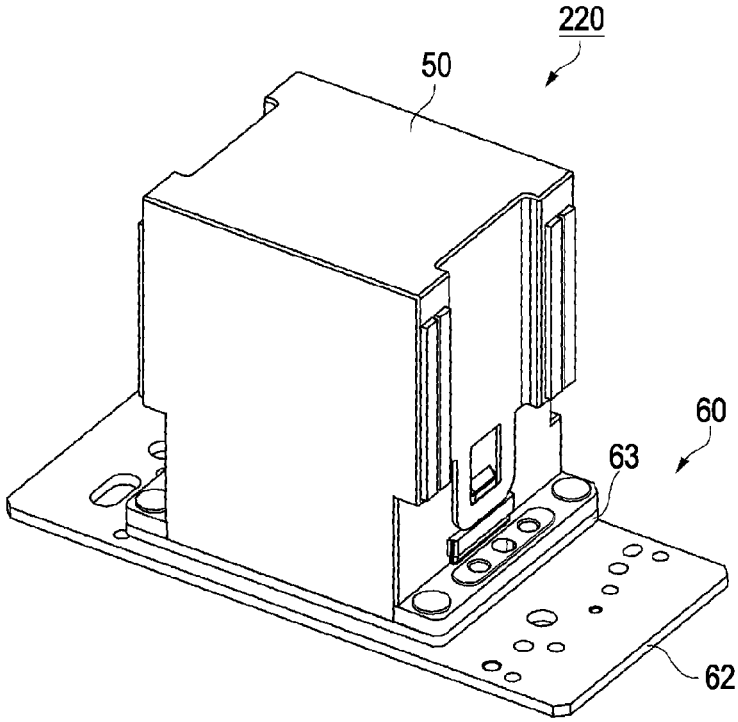
FIG. 7 is a perspective view of a second head unit.

FIG. 7 is a perspective view of the second head unit 220. The second head unit 220 has a fixing unit 60 and the ink jet head 50 as shown in FIG. 7. The fixing unit 60 has a base plate 62 and a fixing plate 63. The second head unit 220 has neither a component nor a mechanism necessary for position adjustment.

Figure 8:
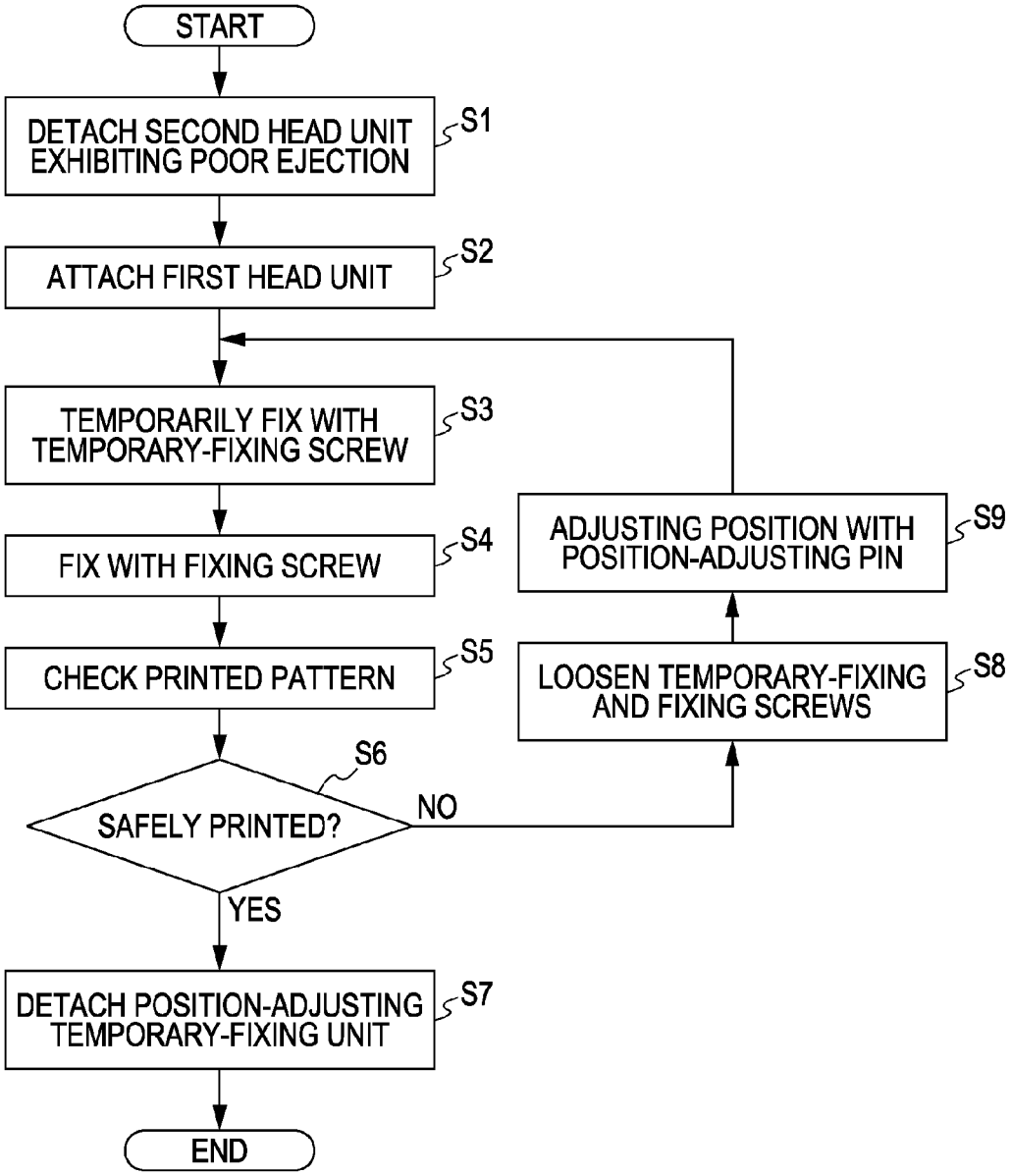
FIG. 8 is a simplified flow chart illustrating a method for adjusting a position.

Adjustment of the position of the ink jet head 50 will now be described in detail with reference to FIGS. 1, 4, 5A, 5B, 7 and 8. FIG. 8 is a simplified flow chart illustrating a method for adjusting the position of the first head unit 210. The method includes the following steps: a first step (S1) as a step of detaching the second head unit 220; a second step (S2) as a step of attaching the first head unit 210; third and fourth steps (S3 and S4) as a step of fixing; fifth and sixth steps (S5 and S6) as a step of checking a printed pattern; and eighth and ninth steps (S8 and S9) as a step of adjusting a position.

The second head unit 220 is detached from the sub-carriage 230 in the first step (S1). Normally, only the second head units 220 are attached on the sub-carriage 230 of the initial (before shipment) image-forming device 100. All the second head units 220 have been fixed on the sub-carriage 230 after position adjustment through attaining optical alignment performed by using a mechanism such as an optical camera.

The second head unit 220 may be detached from the sub-carriage 230 in the case where, for example, poor ink ejection is caused by an ink residue or the like during use of the image-forming device 100. Likewise, the second head unit 220 may be detached in the case where poor print quality occurs due to misregistration or the like of some of the second head units 220. In these cases, only the second head unit 220 which exhibits the poor ink ejection is detached from among the group of the head units 200. In the case where the base plate 62 of the second head unit 220 shown in FIG. 7 has the same structure as the base plate 1 of the position adjustable first head unit 210, the second head unit 220 is detached together with the fixing plate 63 from the base plate 62. On the other hand, in the case where the base plate 62 does not have the same structure as the base plate 1 of the first head unit 210, the second head unit 220 is detached together with the base plate 62 from the sub-carriage 230.

In the second step (S2), the position adjustable first head unit 210 is attached as a substitute for the detached second head unit 220 exhibiting the poor ejection. In the case where the second head unit 220 has been detached together with the base plate 62, the base plate 1 of the first head unit 210 together with the position-adjusting temporary-fixing unit 440 may be attached as a unit. On the other hand, in the case where the second head unit 220 is detached together with the fixing plate 63, the movable plate 2 together with the position-adjusting temporary-fixing unit 440 is attached to the base plate 62 of the second head unit 220, with the base plate 62 remaining attached to the sub-carriage 230.

The movable plate 2 and the second movable plate 8 are temporarily fixed by the temporary-fixing screw 51 and the temporary-fixing screw 58, respectively, in the third step (S3). The tapered portion 52 of the temporary-fixing screw 51 and the tapered portion 59 of the temporary-fixing screw 58 are positioned so as to touch the second tapered surface 25 and the second tapered surface 83, respectively. The second tapered surface 25 performs a temporary fixing functions against movement in the Y-axis direction, while the second tapered surface 83 performs a temporary fixing function which prevents movement in the θ direction.

More specifically, temporary fixing function is performed by moving the temporary-fixing screw 51 and the temporary-fixing screw 58 toward the base plate 1 and the movable plate 2, respectively. Referring to FIGS. 5A and 5B, the tapered portion 52 of the temporary-fixing screw 51 moves while remaining in contact with the second tapered surface 25 when the temporary-fixing screw 51 moves toward the base plate 1. Likewise, the tapered portion 59 of the temporary-fixing screw 58 moves while remaining in contact with the second tapered surface 83, when the temporary-fixing screw 58 moves toward the movable plate 2. When the temporary-fixing screw 51 moves toward the second tapered surface 25, the second tapered surface 25 is subjected to a force in the negative Y-axis direction. On the other hand, when the temporary-fixing screw 58 moves toward the second tapered surface 83, the second tapered surface 83 is subjected to a force in the positive Y-axis direction. Therefore, the movable plate 2 is temporarily fixed by using the position-adjusting pin 41, the temporary-fixing screw 51 and the first locating member 11. Likewise, the second movable plate 8 is temporarily fixed by using the position-adjusting pin 48, the temporary-fixing screw 58 and the second locating member 30.

Additionally, the temporary-fixing screw 51 which is in contact with the second tapered surface 25 is a left-hand screw. Therefore, the second tapered surface 25 is subjected to a force which acts in a direction from the sidewall 22 toward the first locating member 11, as shown in the figure by the broken-line arrow, when the temporary-fixing screw 51 advances toward the second tapered surface 25. As to the temporary-fixing screw 58 being in contact with the second tapered surface 83, both right-hand and left-hand screws may be applicable since an undesirable shifting of the position where the second locating member 30 and the bore 81 are in contact with each other is not likely to happen. However, it is preferable to employ the right-hand screw to apply the force in a direction toward the second locating member 30 (indicated by the arrow with a broken line in the figure) when turning the screw to temporarily fix the second movable plate 8.

The movable plate 2 is fixed to the base plate 1 with the fixing screw 31 in the fourth step (S4). Fixing the movable plate 2 to the base plate 1 is conducted by screwing the fixing screw 31 having the external thread into the threaded bore 13 through the bore 27. The second movable plate 8 is fixed to the movable plate 2 with the fixing screw 38 in the same way as the movable plate 2.

The third step (S3) and the fourth step (S4) may be omitted in the case where the second head unit 220 shown in FIG. 7 is detached together with the base plate 62 from the sub-carriage 230 and the first head unit 210 with the base plate 1 is attached in place thereof, the base plate 1 carrying the movable plate 2 and the second movable plate 8 initially fixed thereon.

On the other hand, the third step (S3) and the fourth step (S4) are necessarily conducted to fix the movable plate 2 at an appropriate position in the case where the second head unit 220 is detached together with the fixing plate 63 from the base plate 62. In this case, the base plate 1, the movable plate 2 and the position-adjusting temporary-fixing unit 440 of the first head unit 210 are attached to the base plate 62 of the second head unit 220, which remains fixed to the sub-carriage 230. Exact position adjustment of the first head unit 210 is conducted in the following steps.

An image pattern for checking the position of the ink jet head is printed in the fifth step (S5). In the sixth step (S6) the printed image pattern is checked to determine whether the printing has been safely executed. The image pattern is safely printed if the ink jet head 50 attached to the exact position. The step proceeds to the seventh step (S7) when it is determined in the sixth step (S6) that the image pattern has safely been printed. In the case where the image pattern has not been safely printed, the step proceeds to the eighth step (S8).

The fixing screws 31 and 38 as well as the temporary-fixing screws 51 and 58 are loosened in the eighth step (S8) so as to allow the movable plate 2 and the second movable plate 8 to move.

The ink jet head 50 is position-adjusted both in Y-axis and θ directions by using the position-adjusting pins 41 and 48, in the ninth step (S9). The position adjustment in the Y-axis direction is described below. The position adjustment in the Y-axis direction is conducted by moving the position-adjusting pin 41 along the Z axis, while keeping the position-adjusting pin 41 in contact with the first tapered surface 24. The tapered portion 42 moves while touching the first tapered surface 24 as the position-adjusting pin 41 moves along the Z axis as shown in FIGS. 5A and 5B.

Here, the position-adjusting pin 41 is movable only in the Z-axis direction. The movable plate 2 moves in the Y-axis direction as the position-adjusting pin 41 moves toward the first tapered surface 24 (in the negative Z-axis direction) to urge the first tapered surface 24. As the position-adjusting pin 41 moves away from the first tapered surface 24 (in the positive Z-axis direction), the movable plate 2 moves in the negative Y-axis direction since the movable plate 2 is pulled by the spring 61 in the negative Y-axis direction.

The travel distance of the movable plate 2 relative to travel distance of the position-adjusting pin 41 depends on an inclination angle of the first tapered surface 24. For instance, the travel distance of the movable plate 2 is equal to that of the position-adjusting pin 41 at the inclination angle of 45 degrees. As the inclination of the first tapered surface 24 becomes larger, the travel distance of the movable plate 2 relative that of the position-adjusting pin 41 becomes smaller; therefore more accurate position adjustment is achieved. The position adjustment on the order of 2 μm is possible by using the micrometer 451 at the inclination of 45 degrees.

The position adjustment in the θ direction will now be described. The position adjustment in the θ direction is conducted by moving the position-adjusting pin 48 along the Z axis, while keeping the position-adjusting pin 48 in contact with the first tapered surface 82. The tapered portion 49 moves while touching the first tapered surface 82 as the position-adjusting pin 48 moves along the Z axis as shown in FIGS. 5A and 5B.

Here, the position-adjusting pin 48 is movable only in the Z-axis direction. The second movable plate 8 moves in the negative Y-axis direction as the position-adjusting pin 48 moves toward the first tapered surface 82 (in the negative Z-axis direction) to urge the first tapered surface 82. As the position-adjusting pin 48 moves away from the first tapered surface 82 (in the positive Z-axis direction), the second movable plate 8 moves in the positive Y-axis direction since the second movable plate 8 is pulled by the spring 68 in the positive Y-axis direction.

The position adjustment in the θ direction is conducted substantially in the same manner as the position adjustment in the Y-axis direction. The position where the position-adjusting pin 48 touches the first tapered surface 82 shifts not only in the Y-axis direction but also in the X-axis direction, in contrast with the position adjustment in the Y-axis direction. Conducted after the position adjustment are the temporary fixing in the third step (S3), the fixing in the fourth step (S4), and the checking the image pattern in the fifth step (S5).

A routine including the eighth step (S8), the ninth step (S9), the third step (S3), the fourth step (S4), the fifth step (S5) and the sixth step (S6) are conducted repeatedly until the image pattern is safely printed. The step proceeds to the seventh step (S7) after safe printing of the image pattern is confirmed.

The position-adjusting temporary-fixing units 440, which are two in number, are detached in the seventh step (S7). It is to be noted, however, only one position-adjusting temporary-fixing unit 440 may be detached or the position-adjusting temporary-fixing units 440 may remain attached.

According to the foregoing embodiment, the following advantages are obtained.

(1) As to the Y-axis direction, the force applied to the first tapered surface 24 when the position-adjusting pin 41 is touching the first tapered surface 24 and the force applied to the second tapered surface 25 when the temporary-fixing screw 51 is touching the second tapered surface 25 have component vectors counter to each other in the Y-axis direction. The position in the Y-axis direction of the movable plate 2 relative to the base plate 1 is stably determined by the forces having vectors counter to each other, one force being applied to the first tapered surface 24 and the other to the second tapered surface 25. As to the θ direction, the force applied to the first tapered surface 82 when the position-adjusting pin 48 is touching the first tapered surface 82 and the force applied to the second tapered surface 83 when the temporary-fixing screw 58 is touching the second tapered surface 83 have component vectors counter to each other in the θ direction. The position in the θ direction of the second movable plate 8 relative to the movable plate 2 is stably determined by the forces having vectors counter to each other, one force being applied to the first tapered surface 82 and the other to the second tapered surface 83. This advantageously suppresses misregistration caused by the rotation of the fixing screws 31 and 38 during fixing the movable plate 2 to the base plate 1 with the fixing screw 31 and fixing the second movable plate 8 to the movable plate 2 with the fixing screw 38. It is therefore possible to obtain a first head unit 210, as well as a method for adjusting the position of the ink jet head 50, which permits accurate positioning and setting of the ink jet head 50.

(2) The ink jet head 50 is position-adjusted both in Y-axis and θ directions, whereby misregistration of the movable plate 2 and the second movable plate 8 caused by the rotation of the fixing screws 31 and 38 can be suppressed. It is therefore possible to obtain a first head unit 210 having the ink jet head 50 fixed at the exact position relative to a plurality of directions.

(3) Tightening the temporary-fixing screws 51 and 58 by screwing increases the forces having vectors in the counter directions, the forces being applied to the first tapered surfaces 24 and 82 and the second tapered surfaces 25 and 83. Therefore, the positions of the movable plate 2 and the second movable plate 8 can more stably be determined relative to the base plate 1 and the movable plate 2, respectively.

(4) The movable plate 2 is urged by the spring 61 to the first locating member 11 which is provided on the base plate 1 and which limits the movement directions of the movable plate 2. Also, the second movable plate 8 is urged to the second locating member 30 by the spring 68, the second locating member 30 controlling movement directions of the second movable plate 8. Therefore, movement in directions except the movement direction of the movable plate 2 and the second movable plate 8 is advantageously prevented. The movable plate 2 and the second movable plate 8 are urged to the position-adjusting pin 41 and the position-adjusting pin 48 by the spring 61 and the spring 68, respectively. With this arrangement, the positions in the movement directions of the movable plate 2 and the second movable plate 8 are determined more stably since the position-adjusting pins 41 and 48 are in contact with respective first tapered surfaces 24 and 82.

(5) The forces applied to the second tapered surfaces 25 and 83 include the vector toward the first locating member 11 and the vector toward the second locating member 30, the forces applied to the position where the temporary-fixing screws 51 and 58 respectively touch the second tapered surfaces 25 and 83. Therefore, the movable plate 2 and the second movable plate 8 are urged to the first locating member 11 and the second locating member 30, respectively. Arranged in such a manner, the positions in the movement directions of the movable plate 2 and the second movable plate 8 are determined more stably.

(6) At least one of the position-adjusting temporary-fixing units 440, each having the position-adjusting pins 41 and 48 and the temporary-fixing screws 51 and 58, may be detached from the first head unit 210 carrying the ink jet head 50 fixed at the exact position by the fixing screws 31 and 38. Therefore, the first head unit 210 after the detachment can be miniaturized. The position of the ink jet head 50 can be readjusted by re-attaching the position-adjusting temporary-fixing unit 440 to the first head unit 210 when the ink jet head 50 needs to be adjusted its position again. Furthermore, the foregoing structure makes it possible to obtain a plurality of the first head units 210 in each of which the ink jet head 50 can be position adjusted and fixed by using only a single pair of position-adjusting temporary-fixing units 440.

(7) The first tapered surfaces 24 and 82 are in face contact with the tapered portion 42 of the position-adjusting pin 41 and the tapered portion 49 of the position-adjusting pin 48, respectively. Likewise, the second tapered surfaces 25 and 83 are in face contact with the tapered portion 52 of the temporary-fixing screw 51 and the tapered portion 59 of the temporary-fixing screw 58, respectively. Therefore, the forces applied to the contact portions are distributed, thereby decreasing friction between the position-adjusting pin 41 and the temporary-fixing screw 51, between the position-adjusting pin 48 and the temporary-fixing screw 58, between the first tapered surface 24 and the second tapered surface 25, and between the temporary-fixing screw 58 and the first tapered surface 82. Therefore, obtained with the forgoing structure is a first head unit 210 which facilitates the movements of the position-adjusting pins 41 and 48 as well as the temporary-fixing screws 51 and 58 is facilitated.

(8) The first head unit 210 having the ink jet head 50 which needs to be position adjusted is Selectively position adjusted. Therefore, the image-forming device 100 and the method for adjusting the position of the ink jet head 50 can be achieved, with which a simplified structure can be obtained as well as time reduction for the adjustment and cost reduction are enabled.

Note that the scope of the invention is not limited to the foregoing embodiment and various modifications of the embodiment may be applicable without departing from the split of the invention. For example, it is possible to provide a mechanism used for the adjustment in the X-axis direction, which is similar to that used for the adjustment in the Y-axis direction to enable a position adjustment in the X-axis direction, thereby enabling the position adjustment in two-directions. Also, the invention is applicable not only to the position adjustment after the shipment but also to the position adjustment when a defect in an ink jet component occurs during the manufacturing steps.

For example, not only two movable components but also three or more movable components may be provided. Also, shapes of the protruding portion 23 and the protruding portion 80 in cross section are not limited to trapezoids.

Furthermore, the movable plate 2 and the first locating member 11 are in contact at the longitudinal line of an external surface of the cylindrical first locating member 11 in the described embodiment, however, they may be in point contact. For instance, arch-shaped or gable-shaped protruding portion with its ends extending in the Y-axis direction may be formed on each of the sidewalls 21 and 22. It is not necessary to employ the cylindrical shape as the first locating member 11, but it suffices to have a shape which touches sidewalls, edges or the like formed on the movable plate 2. For instance, a triangle pole may be employed.

Also, the invention is not exclusively applied to the head unit attached to the fixed sub-carriage 230 described in the embodiment, but also to a head unit attached to a carriage which moves in a line direction which is perpendicular to a column direction in which the recording medium S is transported.

The entire disclosure of Japanese Patent Application No: 2008-028496, filed Feb. 8, 2008 is expressly incorporated by reference herein.

What is claimed is:

1. A method for adjusting a position of a liquid jet head in a liquid jet device having a plurality of head units each including the liquid jet head, the method comprising:

detaching a head unit which needs to be position adjusted from the liquid jet device;

attaching a head unit with a position-adjustable liquid jet head to the liquid jet device;

checking a jet pattern;

position adjusting the liquid jet head by moving at least one of a first movable component that is coupled to liquid jet head or a second movable component that is movably coupled to the first movable component and a base component, wherein the first movable component is adapted for rotational movement with respect to the base component and the second movable component is adapted for lateral movement with respect to the base component;

temporarily fixing the liquid jet head through the use of a plurality of pins by either restricting rotational movement of the first movable component with respect to the second movable component or restricting lateral movement of the second movable component with respect to the base component; and fixing the liquid jet head by utilizing a fixing screw to secure the second movable component to the base component or the first movable component to the second movable component;

wherein fixing the liquid jet head comprises securing the second movable component to the base component by the fixing screw, wherein the second movable component slides on the base component, wherein the head unit has:

a locating member limiting a movement direction in which the second movable component moves, the locating member being provided to the base component, wherein the second movable component has a contact portion touching the locating member, and a first tapered surface and a second tapered surface formed thereon, wherein a vector normal to the first tapered surface has a first component vector extending in the movement direction and a vector normal to the second tapered surface has a second component vector extending in the movement direction, the directions of the first component vector and the second component vector are opposite to each other, wherein the base component has a first pin accessible to the first tapered surface and a second pin accessible to the second tapered surface, wherein the position adjusting is effected by one of the first pin and the second pin while the second movable component is urged to the locating member, wherein the second movable component is temporarily fixed to the base component with the first pin or the second pin which is different from the pin for the position adjusting in the temporary fixing, and wherein the second movable component is fixed to the base component with the fixing screw in the fixing of the liquid jet head.

2. The method for adjusting the position of the liquid jet head according to claim 1, the method comprising:

detaching at least one of the first pin and the second pin.

* * * * *